US005711995A

United States Patent [19]

Batzar

[11] Patent Number: 5,711,995

[45] **Date of Patent: *Jan. 27, 1998**

[54] ANGLE SPRAYING OF COOKWARE

[75] Inventor: Kenneth Batzar, Cherry Hill, N.J.

[73] Assignee: E. I. Du Pont de Nemours and Company, Wilmington, Del.

[ * ] Notice: The term of this patent shall not extend beyond the expiration date of Pat. No. 5,707,688.

[21] Appl. No.: 481,682

[22] Filed: Jun. 7, 1995

Related U.S. Application Data

[63] Continuation-in-part of Ser. No. 362,079, Dec. 22, 1994, abandoned.

[51] Int. Cl.[6] ..... B05D 1/38; B05D 5/02; B05D 3/02

[52] U.S. Cl. ..... 427/258; 427/265; 427/267; 427/287

[58] Field of Search ..... 427/258, 265, 427/267, 287, 385.5; 428/420, 422

[56] References Cited

U.S. PATENT DOCUMENTS

| | | | |
|---|---|---|---|
| 3,655,421 | 4/1972 | Long | 117/45 |
| 4,169,083 | 9/1979 | Vassiliou | 260/23 |
| 4,259,375 | 3/1981 | Vassiliou | 427/267 |
| 4,311,634 | 1/1982 | Vassiliou | 260/42.27 |
| 4,677,000 | 6/1987 | Gardaz et al. | 427/261 |
| 4,711,802 | 12/1987 | Tannenbaum | 428/207 |
| 5,233,358 | 8/1993 | Yamada et al. | 430/18 |

FOREIGN PATENT DOCUMENTS

| | | |
|---|---|---|
| 285 161 | 2/1992 | European Pat. Off. . |
| 2 594 673 - A3 | 8/1987 | France . |
| 1 572 842 | 8/1980 | United Kingdom . |
| 2 174 315 | 11/1986 | United Kingdom . |

*Primary Examiner*—Shrive Beck
*Assistant Examiner*—Fred J. Parker

[57] ABSTRACT

Cookware with a multi-layer, non-stick coating on its cooking surface has a random spattered pattern of raised dots or globules in an inner coat, made by spraying the globules on at an angle to create a random, stone-like appearance.

7 Claims, No Drawings

ANGLE SPRAYING OF COOKWARE

CROSS REFERENCE TO RELATED APPLICATIONS

This is a continuation-in-part of application Ser. No. 08/362,079 filed Dec. 22, 1994 abandoned.

BACKGROUND OF THE INVENTION

This invention concerns non-stick coated cookware, with a decorative pattern visible through a light transmitting topcoat. More specifically, it concerns such cookware with a pattern formed by irregular discontinuous globules.

U.S. Pat. No. 4,259,375—Vassiliou (1981 ) discloses an article of cookware with a 3-layer coating having a discontinuous speckled or spattered pattern in a partial layer directly beneath the topcoat. The spattered coating is deliberately sprayed directly on the layer under it while the under layer is still wet and soft so that the spattered layer sinks into the under layer and does not provide roughness that could telegraph through the surface. It was said that roughness would provide a place for a fork or other utensil to catch in the coating and tear the coating. The spattered layer dots were also sprayed on directly, such as at 90 degrees from the substrate, so as to form more or less round dots. This patent is incorporated by reference herein for its disclosure of materials and equivalents suitable for the present invention.

U.S. Pat. No. 3,961,993—Palisin (1976) discloses spraying multilayer polymer coatings on a substrate, one layer being sprayed on top of the layer under it after the under layer has become tacky. A tacky underlayer permits the successive layer to adhere better without completely merging indistinguishably with the underlayer. Still, any roughness in the upper layer would tend to smooth out as the two layers interact.

U.S. Pat. No. 3,655,421—Long (1972) describes means of keeping globules of an intermittent coating from flowing out to make a uniform layer, by controlling surface tension relations.

It is desirable to have a superior non-stick, decorative coating for cookware optionally with a raised or textured surface and with greater flexibility for aesthetic design than just to make smooth round dots.

SUMMARY OF THE INVENTION

The present invention provides a method of making an article of cookware having a cooking surface which comprises a multi-layer, non-stick coating which minimizes sticking by food residues and which is heat resisting by being stable at temperatures above 300° C. on a substrate, wherein the coating comprises a primer adhered to the substrate, a non-stick, heat-resisting, light-transmitting topcoat, and optionally one or more intermediate coats, with the topcoat adhered to any such intermediate coats which are adhered to the primer or, in the absence of intermediate coats, the topcoat being adhered directly to the primer, with the coating under the topcoat having a first color or darkness, wherein a discontinuous layer of raised globules is present on and covers no more than 80% of the area of the coating under the topcoat, said globules having at least one color or darkness which is visibly different than said first color or darkness as seen through said topcoat, said discontinuous layer creating a texture or roughness in said topcoat wherein the globule coating is sprayed onto the substrate at an angle of the center of the spray stream to the substrate in the range of 30 to 75 degrees, creating a spattered pattern of non-round dots.

DETAILED DESCRIPTION

An important part of the process for obtaining the present invention is the drying or "flashing" the primer or intermediate coat before applying the discontinuous coat, adequately so the spattered dots do not sink into the primer or the intermediate coat. In normal application, air flow for 30 seconds or longer, or preheating the substrate or the air with a shorter time of air flow, will suffice.

Those skilled in the art know how to select the ingredients of each coating to avoid wetting which might cause the globules to run together. Wetting is generally not a problem with most heat resistant materials useful for cookware coatings, especially perfluoropolymers such as polytetrafluoroethylene and (PTFE) and copolymers of TFE and fluorovinyl ethers (PFA).

Preferably the coatings contain oxide-coated mica, and preferably the oxide in $TiO_2$, as described in U.S. Pat. Nos. 3,087,827—Klenke et al., 3,087,828 and 3,087,829—both to Linton, and granted 1963.

In the examples which follow, parts, percentages and proportions are given by weight except where stated otherwise.

EXAMPLE 1

A primer having the composition of Table 1 is sprayed on a clean, lightly etched aluminum substrate to a dry film thickness (DFT) of 7.5 to 10 microns, the primer is dried at 66° C. for 3 minutes and a black midcoat of Table 2 is applied to a DFT of 17.5 to 20 microns. The midcoat is allowed to dry at ambient temperature for 45 seconds and three separate inks or spatter coatings are applied using a DeVilbiss spatter gun to provide a discontinuous coating. The inks of Table 3 or 4 are colored to be significantly different than the black midcoat background and are sprayed at a 45° angle (or at an angle of from 30° to 75°, preferably 45° to 60°) to provide irregular shapes on the spinning substrate. The effect is to provide an appearance of natural stone. The inks are not limited to solid color pigments but also include color achieved by reflectance with coated mica. A topcoat of Table 5 is then applied wet-on-wet over the spattered particles. The topcoat, in this example, contains mica particles in a 1–15 micron particle size range so as not to interfere with the aesthetics of the spatter coat. The entire system is sintered at 427° to 435° C. for 5 minutes, with the measured temperature being that of the metal substrate.

TABLE 1

| Primer | Coating Composition (Wt. %) | Solids Content in Finished Article (Wt %) |
|---|---|---|
| Furfuryl Alcohol | 1.82 | — |
| Polyamic acid salt in N-Methyl Pyrrolidone | 18.10 | 24.48 |
| Water | 43.33 | — |
| Mica coated with $TiO_2$ | 0.05 | 0.24 |
| PTFE Dispersion | 7.93 | 22.19 |
| FEP Dispersion | 5.88 | 15.08 |
| Colloidal Silica Dispersion | 3.58 | 5.00 |
| Ultramarine blue dispersion | 13.74 | 32.06 |
| Aluminum silicate dispersion | 0.58 | 0.94 |

TABLE 2

| Intermediate | Coating Composition (Wt. %) | Solids Content in Finished Article (Wt %) |
|---|---|---|
| PTFE Dispersion | 56.34 | 77.43 |
| PFA Dispersion | 10.21 | 14.22 |
| Water | 4.62 | — |
| Carbon black dispersion | 2.71 | 3.79 |
| Ultramarine blue dispersion | 0.49 | 3.22 |
| Mica coated with $TiO_2$ | 0.75 | 1.73 |
| Surfactant catalyst soln. | 12.63 | — |
| Acrylic dispersion | 12.23 | — |

TABLE 3

Typical spatter ink formulation composition (parts by weight)

| | A (white) | B (gray) | C (brown) |
|---|---|---|---|
| PTFE Dispersion | 542.0 | 542.0 | 542.0 |
| PFA Dispersion | 96.0 | 96.0 | 96.0 |
| Ceramic Dispersion | 50.0 | 50.0 | — |
| $TiO_2$ Dispersion | 100.0 | 100.0 | 20.0 |
| Iron Oxide Dispersion | — | — | 80.0 |
| Channel Black Dispersion | — | 8.0 | 2.0 |
| Solvent Surfactant Blend | 110.00 | 110.00 | 110.00 |
| Acrylic Dispersion | 120.00 | 120.00 | 120.00 |
| Solvent-Surfactant Blend | 30.00 | 30.00 | 30.00 |
| Hydroxyl propyl cellulose soln. | 30.00 | 15.00 | 20.00 |
| Viscosity in centipoise as measured by Brookfield #2 spindle, @ 20 rpm | 682 | 608 | 682 |

TABLE 4

| | White | | Gray | |
|---|---|---|---|---|
| Spatter Coats | Coating Composition (Wt. %) | Solids Content in Finished Article (Wt. %) | Coating Composition (Wt. %) | Solids Content in Finishes Article (Wt. %) |
| PTFE Dispersion | 50.29 | 71.04 | 50.61 | 70.63 |
| PFA Dispersion | 8.91 | 12.58 | 8.96 | 12.52 |
| $Al_2O_3$ Ceramic Dispersion | 4.64 | 5.46 | 4.67 | 5.43 |
| $TiO_2$ Dispersion | 9.28 | 10.92 | 9.34 | 10.86 |
| Carbon black Dispersion | — | — | 0.75 | 0.52 |
| Surfactant-Catalyst Solution | 12.99 | — | 13.07 | — |
| Acrylic Dispersion | 11.13 | — | 11.20 | — |
| Hydroxyl propyl cellulose soln. | 2.78 | — | 1.40 | — |
| Viscosity in centipoise as measured by Brookfield #2 spindle, @ 20 rpm | | 682 | | 608 |

TABLE 5

| Topcoat | Coating Composition (Wt. %) | Solids Content in Finished Article (Wt %) |
|---|---|---|
| PTFE Dispersion | 66.73 | 94.04 |
| PFA Dispersion | 3.51 | 4.95 |
| Water | 3.77 | — |
| Mica coated with $TiO_2$ | 0.43 | 1.01 |
| Surfactant catalyst soln. | 12.52 | — |
| Acrylic dispersion | 13.04 | — |

I claim:

1. A method for making a coated substrate comprising in sequence:

applying at least one fluoropolymer-containing primer layer onto a substrate, applying at least one fluoropolymer-containing intermediate layer upon said primer layer, drying said at least one fluoropolymer-containing intermediate layer, and;

spraying at an angle of 30 to 75 degrees at least one fluoropolymer-containing discontinuous layer comprising raised globules over less than about 80% of the dried at least one fluoropolymer-containing intermediate layer, and applying at least one fluoropolymer-containing topcoat.

2. The method of claim 1 further comprising sintering.

3. The method of claim 1 wherein said primer layer comprises polytetrafluoroethylene and fluorinated ethylene-propylene copolymer.

4. The method of claim 1 wherein said at least one fluoropolymer-containing intermediate layer comprises polytetrafluoroethylene and perfluorovinylalkyl vinyl ether copolymer with tetrafluoroethylene.

5. The method of claim 1 wherein said topcoat comprises polytetrafluoroethylene and perfluorovinylalkyl vinyl ether copolymer with tetrafluoroethylene.

6. The method of claim 1 wherein at least one of said primer layer, at least one fluoropolymer-containing intermediate layer and said fluoropolymer-containing topcoat comprise mica coated with titanium dioxide.

7. The method of claim 1 wherein the globules comprise at least one pigment.

* * * * *